United States Patent [19]

Roche

[11] 4,134,635

[45] Jan. 16, 1979

[54] CONNECTOR FOR WATERPROOF RECHARGEABLE LAMP

[76] Inventor: Thomas F. Roche, 21 W. Main St., Merrimac, Mass. 01860

[21] Appl. No.: 856,417

[22] Filed: Dec. 1, 1977

[51] Int. Cl.[2] ..... H01R 3/04

[52] U.S. Cl. ..... 339/117 R; 174/67; 362/109; 362/183; 339/36; 339/113 L; 320/2

[58] Field of Search ..... 174/67, 138 F; 362/109, 362/183; 339/117 R, 117 P, 113 L, 36, 89 R; 320/2, 46

[56] References Cited

U.S. PATENT DOCUMENTS

| | | | |
|---|---|---|---|
| 2,099,610 | 11/1937 | Ledder | 339/117 R X |
| 3,081,366 | 3/1963 | Belove | 320/46 UX |
| 3,129,993 | 4/1964 | Ross | 339/36 X |
| 3,233,092 | 2/1966 | Umholtz | 362/183 |
| 3,950,055 | 4/1976 | Samuels et al. | 174/67 X |

*Primary Examiner*—Roy Lake
*Assistant Examiner*—DeWalden W. Jones
*Attorney, Agent, or Firm*—Weingarten, Maxham & Schurgin

[57] ABSTRACT

A connector assembly for rechargeable battery-operated power supplies requiring a watertight housing. Such a connector is usable, for example, in conjunction with a waterproof housing for a hand-carried, rechargeable floodlight. The connector assembly incorporates a male connector member affixed to the exterior of the housing for mating with a female connector via which power may be supplied to recharge a battery maintained within the housing. Vents which permit gases generated by the charging operation to escape from the housing are located interior to the periphery of said connector assembly. When the battery is not being recharged, the connector assembly is covered by a watertight cap, thereby closing the vents and protecting the male connector member. A pilot lamp charge indicator is provided, and the cap provides protection against injury thereto.

8 Claims, 2 Drawing Figures

CONNECTOR FOR WATERPROOF RECHARGEABLE LAMP

FIELD OF THE INVENTION

This invention relates to watertight housings for rechargeable, battery-operated power supplies and, in particular, to the same as applied to hand-carried electrical lamps.

BACKGROUND OF THE INVENTION

Waterproof housings are known in the prior art for containing rechargeable, battery-operated power supplies for use in various applications. When the batteries of such power supplies are being charged, and resultant electrochemical action produces gaseous by-products which build up within the enclosure and must be permitted to escape therefrom. Prior art enclosure or housing designs have thus incorporated gas escape vents which may alternately be capped to provide a watertight seal when the equipment is in use and easily opened during the charging operation. If the user forgets to reseal one or more of these vents upon conclusion of the charging operation, the housing is, obviously, not watertight. If it is not realized that this situation exists, the equipment may be used as though it were watertight, permitting water to enter the housing and damage the batteries and charging apparatus therein contained. Further, should the equipment have dropped into a body of water, the open vent may lead to sinking of the unit, rather than the expected floating thereof.

BRIEF SUMMARY OF THE INVENTION

In a preferred embodiment for the present invention, a rechargeable, battery-operated, hand-carried electric lamp is shown having a housing for containing the required battery and charging apparatus therefor. The housing is provided with a connector assembly comprising a receptacle assembly and a cap therefor. When the cap is installed over the receptacle assembly, it closes the housing with a watertight seal. Within the periphery of the receptacle assembly which is sealed by the cap, one or more vent holes are provided, obviating the need for the separate vent holes and caps therefor as employed in the prior art. Thus, sealing the receptacle assembly with the cap automatically seals the vent holes, and it is not necessary to remember to seal vents in addition to a receptacle assembly. A suitable electrical connector is also provided as part of the receptacle assembly to permit power to be supplied to the charging apparatus to recharge the battery. Also mounted on the housing, adjacent to the receptacle assembly and close enough thereto to be protected by the rim of the cap when it is installed thereon, is a pilot lamp for indicating the charge status of the battery.

BRIEF DESCRIPTION OF THE DRAWINGS

These and other features of the present invention are more fully described below in the detailed description of the preferred embodiment and in the accompanying drawing of which.

DETAILED DESCRIPTION OF THE INVENTION

The present invention contemplates apparatus providing a connector assembly for a watertight housing for a rechargeable, battery-operated power supply. Such power supplies are used, for example, for portable, hand-carried flood lamps and lanterns. These items may be such as to be particularly intended for use in marine environments wherein it is important to maintain the watertight integrity of the battery housing. It is further intended that the connector assembly will include one or more vent holes for permitting gases generated during the battery charging operation to be released from the interior of the housing, without the necessity for using vents which require closing means in addition to the connector closing means. Thus, it is principally intended that the connector permits the battery charging operation to be accomplished by the simple removal of a single connector cap, the connection of a power cable to supply charging power, the removal of such cable at the termination of the charging operation, and the closing of the connector with the aforesaid cap.

Figure 1:
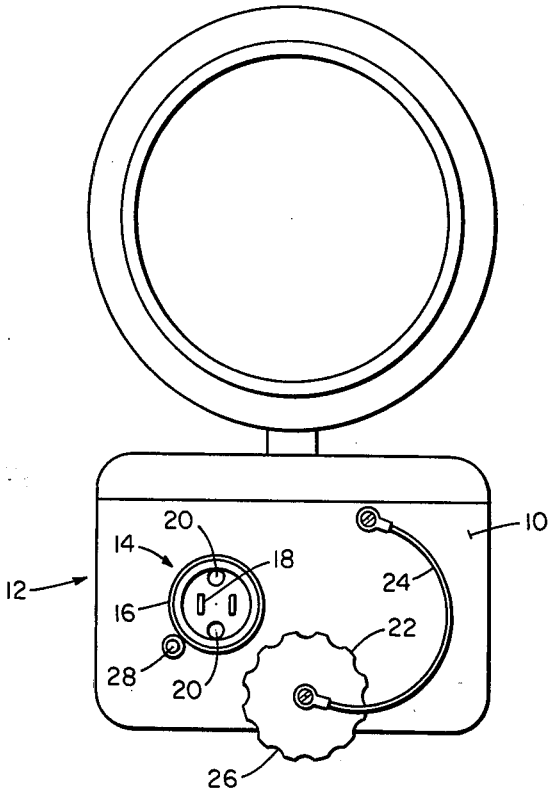
FIG. 1 is a front, diagrammatic view of a hand-carried, portable flood lamp incorporating a rechargeable, battery-operated power supply incorporating the present invention, showing the cap removed from the receptacle assembly.
Figure 2:
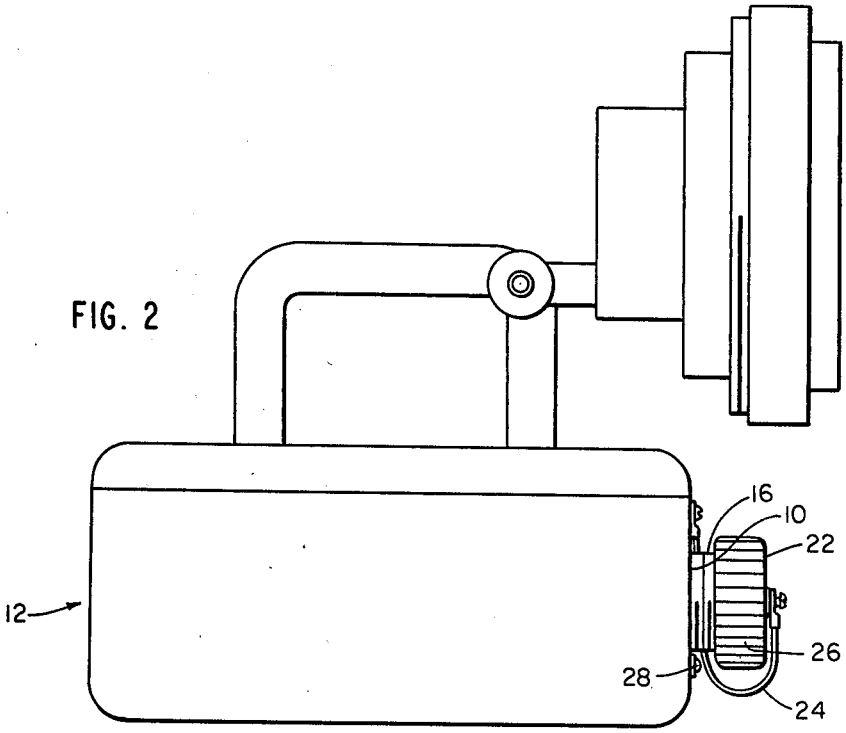
FIG. 2 is a side view of the apparatus of FIG. 1.

The basic structure of the subject connector is shown in FIGS. 1 and 2. On end surface 10 of housing 12 there is provided a connector receptacle assembly 14. The receptacle assembly comprises a threaded sleeve in watertight, sealing engagement with surface 10. Within the inner circumference of the threaded sleeve section is mounted a male electrical connector 18 suitable for mating with a corresponding female electrical connector for supplying power to recharge the battery. Additionally, one or more holes 20 are provided through the end surface 10 within the region thereof bounded by the threaded sleeve 16. Holes 20 function as vents to permit gases generated by the battery during the charging cycle to escape from the interior of the housing.

Cap 22 comprises a member having an interior diameter adaptively threaded to be mated to the exterior threading of the sleeve 16; and, when threadably engaging said sleeve, the cap establishes a watertight seal against the open end thereof. A retainer cable 24 is attached at one of its ends to surface 10 and at its other end to cap 22, to prevent the cap from being lost.

Whereas the inner diameter of cap 22 is approximately the same as the outer diameter of threaded sleeve 16, the outer diameter of cap 22 is somewhat larger. In particular, the edge of cap 22 is grooved or knurled, as illustrated by the notches 26 therein, to facilitate gripping. It is thus possible, as shown, to place a pilot lamp 28, for indicating the charge status of the battery, on surface 10 adjacent sleeve 16, such that it will be protected by cap 22 when the cap is screwed onto the sleeve.

It should thus be appreciated that the principal advantage of this structure lies in the fact that a single cap is used to cover both the vent holes and the electrical connector through which battery charging power is supplied. As stated above, a first safety aspect of this arrangement is that only one cap need be fastened in place at the conclusion of a charging operation, without the need for separately covering vent holes with additional caps and the attendant possibility that the user might forget to do so or might improperly replace one or more caps. A second safety aspect is that the vent holes are automatically exposed before it is even possible to begin a charging operation. In the prior art, wherein the vent holes must be separately uncapped, the failure to uncap the vent holes creates a serious hazard due to the generation of volatile gases within the housing and the generation of pressure as a result. Since there may be exposed electrical connections within the housing, with the possibility of a spark or arc being produced therefrom, it is important that the volatile gases emitted by the battery during the recharging cycle be provided such an escape route, lest an explosion result.

It is to be appreciated that the above thus described embodiment for the present invention is illustrative only, alterations and modifications being deemed to be within its spirit and scope. Thus, the breadth of the invention is intended to be limited only as defined in the following claims.

What is claimed is:

1. A connector assembly for a water proof housing for a rechargeable, battery-operated power supply comprising:

an electrical connector mounted on an exterior surface of said housing, by which power may be supplied to recharge said battery;

means for establishing a sealable perimeter against said surface and enclosing said connector;

the portion of said surface within said perimeter having at least one hole therethrough, through which gases may be vented from the interior of said housing to the exterior thereof during the battery recharging operation; and means for providing a watertight seal against the exterior surface of the housing and enclosing the sealable perimeter, the means being removable to permit access to the electrical connector.

2. The connector assembly of claim 1 wherein the means for establishing a sealable perimeter comprises an externally threaded, hollow sleeve having one end in sealing engagement with the exterior surface of the housing, to define the sealable perimeter.

3. The connector assembly of claim 2 wherein the means for providing a watertight seal comprises a cap having an inner diameter adaptively threaded to receive and mate with and provide a watertight seal against the end of said threaded sleeve opposite the end thereof in engagement with said surface.

4. A housing for a rechargeable, battery-operated power supply having a sealable connector assembly to provide a watertight seal when closed, and when open, permitting electrical power to be supplied thereto to recharge said battery and permitting the escape therethrough of gases generated within said housing while said battery is being charged, comprising:

the housing having an exterior surface;

an electrical connector member mounted on said exterior surface of the housing, through which power may be supplied to recharge the battery;

means for establishing a sealable perimeter against said surface and enclosing said connector member;

the portion of said surface within said perimeter having at least one hole therethrough, through which gases may be vented from the interior of said housing to the exterior thereof during the battery recharging operation; and means for providing a watertight seal against the exterior surface of the housing and enclosing the sealable perimeter, said means being removable to permit access to the electrical connector.

5. The housing of claim 4 wherein the means for establishing a sealable perimeter comprises an externally threaded, hollow sleeve having one end in sealing engagement with the exterior surface of the housing, to define the sealable perimeter.

6. The housing of claim 5 wherein the means for providing a watertight seal comprises a cap having an inner diameter adaptively threaded to receive and mate with and provide a watertight seal against the end of said threaded sleeve opposite the end thereof in engagement with said surface.

7. In a hand-carried, waterproof, battery-operated, rechargeable electric lamp, including a battery, recharging apparatus therefor and a housing for containing said battery and recharging apparatus, the improvement comprising:

said housing having an exterior surface;

an electrical connector member mounted on the exterior surface of the housing, by which power may be supplied to recharge the battery;

means for establishing a sealable perimeter on said surface, said perimeter enclosing said connector member;

said surface having, within said perimeter, at least one hole therethrough; and means for providing a watertight seal against the exterior surface of the housing and enclosing the sealable perimeter.

8. The lamp of claim 7 wherein said sealable perimeter is provided by a hollow, externally threaded sleeve having a first end in sealing engagement with said exterior surface and said means for providing a watertight seal comprises a cap having an inner diameter adaptively threaded to receive and mate with and provide a watertight seal against an end of said threaded sleeve opposite the end thereof in sealing engagement with said exterior surface of the housing.

* * * * *